US005136926A

United States Patent [19]

Bies et al.

[11] Patent Number: 5,136,926

[45] Date of Patent: Aug. 11, 1992

[54] VIBRATION GENERATOR WITH A CONTROL VALVE IN AN INERTIAL BODY CONTROLLED BY A WAVE FORM SHAPE OF FLUID FLOW TO THE VALVE

[76] Inventors: David A. Bies, 4 Parslow Road, Marion, State of South Australia; Stewart Page, P.O. Box 183, Summertown, South Australia, 5141, both of Australia

[21] Appl. No.: 459,760

[22] PCT Filed: Jun. 24, 1988

[86] PCT No.: PCT/AU88/00212

§ 371 Date: Dec. 21, 1989

§ 102(e) Date: Dec. 21, 1989

[87] PCT Pub. No.: WO88/10157

PCT Pub. Date: Dec. 29, 1988

[51] Int. Cl.[5] ..... F15B 21/02

[52] U.S. Cl. ..... 91/39; 91/226; 91/327; 60/459

[58] Field of Search ..... 91/39, 226, 327; 60/459

[56] References Cited

U.S. PATENT DOCUMENTS

| | | | |
|---|---|---|---|
| Re. 32,995 | 7/1989 | Fair | 91/39 |
| 2,970,570 | 2/1961 | Hill | 91/39 |
| 3,368,457 | 2/1968 | Lewakowski | 91/39 |
| 3,460,343 | 8/1969 | Touchman | 60/487 |
| 3,678,803 | 7/1972 | Schwenzfeier | 91/39 |
| 3,895,561 | 7/1975 | Felderhoe . | |
| 3,896,889 | 7/1975 | Bouyoucos . | |
| 4,235,154 | 11/1980 | Hotton | 91/39 |
| 4,317,406 | 3/1982 | Takahashi | 91/39 |
| 4,442,755 | 4/1984 | Rozycki | 91/39 |

FOREIGN PATENT DOCUMENTS

| | | |
|---|---|---|
| 2541949 | 1/1976 | Fed. Rep. of Germany . |
| 2238075 | 2/1975 | France . |
| 656447 | 8/1951 | United Kingdom . |
| 1330414 | 9/1973 | United Kingdom . |
| 1362213 | 7/1974 | United Kingdom . |

OTHER PUBLICATIONS

Patent Abstracts of Japan, Hitachi Kenki KK May 3, 1982 M137 p. 108 57-40026.

Derwent Abstract Accession No. 87.361138/51.

Resnick et al, Physics pp. 372-374 ©1966.

*Primary Examiner*—Edward K. Look

*Assistant Examiner*—F. Daniel Lopez

*Attorney, Agent, or Firm*—Oldham, Oldham & Wilson Co.

[57] ABSTRACT

A vibration generator including an inertial body and a housing which are relatively movable and where hydraulic fluid is directed into the inertial body through a control valve mounted in the inertial body, the fluid being directed alternately into one or another working chamber which causes oscillation of the housing and any attached load. A wave form shape of pressure or flow rate of the hydraulic fluid flow is detected and used to control the frequency at which the vibration generator oscillates so that the frequency is maintained at a resonant frequency. The device has particular application in a frequency range of 20 Hertz to 1000 Hertz.

12 Claims, 5 Drawing Sheets

VIBRATION GENERATOR WITH A CONTROL VALVE IN AN INERTIAL BODY CONTROLLED BY A WAVE FORM SHAPE OF FLUID FLOW TO THE VALVE

This invention relates to vibratory power generators.

This invention specifically relates to vibratory power generators of a type in which power is derived through pumped hydraulic fluid and which is arranged to provide a driving force the amplitude of which will cyclically vary.

This invention is directly concerned with providing substantial mechanical power of oscillatory character at frequencies from about 20 Hertz up to the order of at least about 1000 Hertz, although having greatest interest in the difficult range of 200–500 Hertz.

Devices that have hitherto been used such as rotating weights have a significant problem in that they depend upon mechanical parts such as bearings which are unable to be economically designed to withstand the necessary forces.

Levels of power to which this invention is directed are such that such power will be adequate to effect the driving of piles.

Further, with previous devices, the method of creating such forces can result in forces causing reaction in a number of directions which can have the result of introducing not only extraneous but interfering forces which are either of no benefit or have a deleterious effect on a result required.

Such can be the case for instance where a rotating weight device is used to create ground waves for examination of characteristics of the earth beneath the ground.

An example of a device that uses hydraulic fluid to create vibratory impact is shown in Australian Patent 479534 in the name of A/S Moelven Brug. This has difficulties insofar that the rotary valve by which hydraulic fluid is controlled is used to provide a reaction effect and the surrounding housing is attached to the load to which the hydraulic couplings must be made in lateral disposition to the expected reaction movement.

With this arrangement, the couplings connecting the hydraulic lines being subject to substantial reactionary forces will introduce significant limitations to the total power that can be effected in this manner. The object of this invention is to avoid some of the difficulties associated with previous proposals.

According to this invention then there is proposed an arrangement to effect a periodically varying force including an inertial body, a valve within the inertial body, housing means adapted to be affixed to load means and slidably moveable with respect to the inertial body, a source of fluid pressure connected to the inertial body, means to control the valve so as to periodically and alternately direct the fluid at pressure into a first working chamber and then a second working chamber, each working chamber being defined by the housing means and the inertial body, and such that introduction of fluid at pressure into the first chamber will effect a force urging the housing to move in a first direction relative to the inertial body and in which direction the housing means is movable relative to the body, and introduction of fluid at pressure into the second chamber will effect a force urging the housing to move in a second direction which is opposite to the first said direction and in which second direction the housing means is moveable relative to the body.

In preference, the valve also provides for exhausting of the fluid at pressure from the respective working chambers.

In preference, the fluid at pressure is an hydraulic fluid and there are means to direct said hydraulic fluid within the inertial body to the valve and there are means to direct said hydraulic fluid subsequent to exhaustion from a working chamber through the inertial body.

In preference, the valve is a mechanical device which is rotatably driven whereby to effect the alternate and periodic direction of said fluid at pressure.

In preference, the inertial body includes two coaxially aligned conduits, there being thereby defined a first passageway through the inertial body between said inner conduit and said outer conduit, and a second passageway being through the inner conduit.

In preference, the means for effecting rotation of the valve comprise an inner conduit which is adapted to be rotated about its own cylindrical axis and the end of which is adapted to effect a valve like action with respect to ports through the outer conduit.

In preference, the housing means are adapted to be slidably moveable with respect to the inertial body by being sealably and slidably connected to slide along the axial direction of the conduits defining the inertial body.

In preference, the means effecting control of the rate of change of direction effected by the valve are controllable in speed.

One of the significant advantages of the arrangement described is that substantially all of the parts which will provide inertial resistance to any vibration are located in only one of the components namely the inertial body which thereby allows the housing to be kept relatively light. This then allows for the inertial centre of the load to be kept a greater distance away from the generation source than might otherwise have to be the case.

The advantage of this is that the distance of a resonant node can therefore also be kept at a greater distance from the generation source which can have significant advantages.

Further however couplings to provide fluid at pressure, or particularly hydraulic fluid at pressure, will be much more secure if attached to the substantially stationary inertial body.

In preference, the arrangement is adapted to operate within the range 200 hertz to 500 hertz and there are means to control the valve so that it might rotate so as to effect a vibration power generation within the said range of frequency.

A next significant feature of the invention relates to the discovery that characteristics detectable within either the flow rate or pressure change of the fluid being supplied at pressure can be used to determine whether a driving frequency is either above or below a resonant frequency of the attached load.

It will generally be known that if a vibrational generating apparatus can drive a load at a dominant resonant frequency, then the effect of any driving force can be extremely efficiently used and this to an extent that limit of effective action will be limited only by other means.

Such other means can be the total available capacity of the pumped hydraulic fluid pressure or velocity, or it can be the total restriction within the hydraulic supply lines, or of course there can be frequency changing such that the matching of the driving frequency with a resonant frequency of the load is controlled to the extent that it is only necessary to achieve the task called for. Hence, holding the frequency just off the predominant resonant frequency may be sufficient for the purposes.

Alternatively, there can be applied within the hydraulic flow means to control the total volume, or there can be means to control the pressure as is appropriate to the circumstances.

It is envisaged, however, that without these limitations, the device if held at resonance may incur forces beyond its capacity to sustain these and hence fail.

Because the apparatus according to the features thus far described can be held at a frequency which can be substantially independent of the extent of loading insofar that control of the rotation of a valve is unaffected by the load controlled by that valve, it then becomes very attractive to consider holding a vibrational frequency being generated at a frequency which is matching resonance or is indeed able to change quickly to follow a changing resonant frequency.

One of the problems however in detecting potential resonance is to establish whether the frequency being offered is higher or lower than the resonant frequency of the load.

There has indeed been a discovery which has made such potential now apparently possible and this is that there are exhibited changes in hydraulic fluid pressure over time, or changes in flow rate over time, which are characteristically different if the speed of the supplying frequency generator is above or below resonant frequency of the driven load.

Such a wave-shape difference can accordingly be used to control the action of the control valve, and where this is a rotatable valve the speed of rotation and of course then hold this or change this as appropriate to bring the frequency substantially matching the resonant frequency of the driven load.

The reasons for this change of wave-shape appears to be that upon the reaction of the load to the applied hydraulic pressure, one of two reactions will predominate, namely an inertial type reaction or a resilient type reaction depending as to whether the driving force is driving the load above resonant frequency or below this.

Accordingly one can expect inertial effects to become more predominant at an initial commencement of application of a force where the frequency is higher than resonance, and the resilient effect will predominate where the frequency is lower than resonance so that any pressure build up within the hydraulic fluid will have a characteristic shape showing essentially the negative or positive slope as appropriate.

According to a preferred arrangement, there are provided means detecting such change in the flow rate in the one instance or pressure changes in the other in the supply conduits for the fluid at pressure.

The invention will be better understood when referred to embodiments and these will now be described with the assistance of drawings in which.

Figure 1:
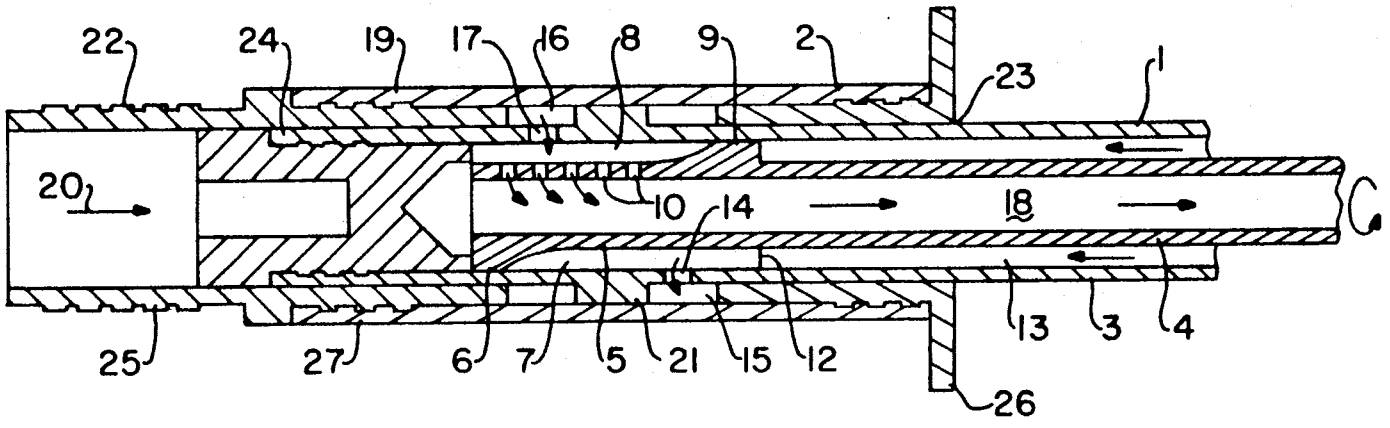
FIG. 1 is a cross-sectional view through an apparatus according to a first embodiment.
Figure 2:
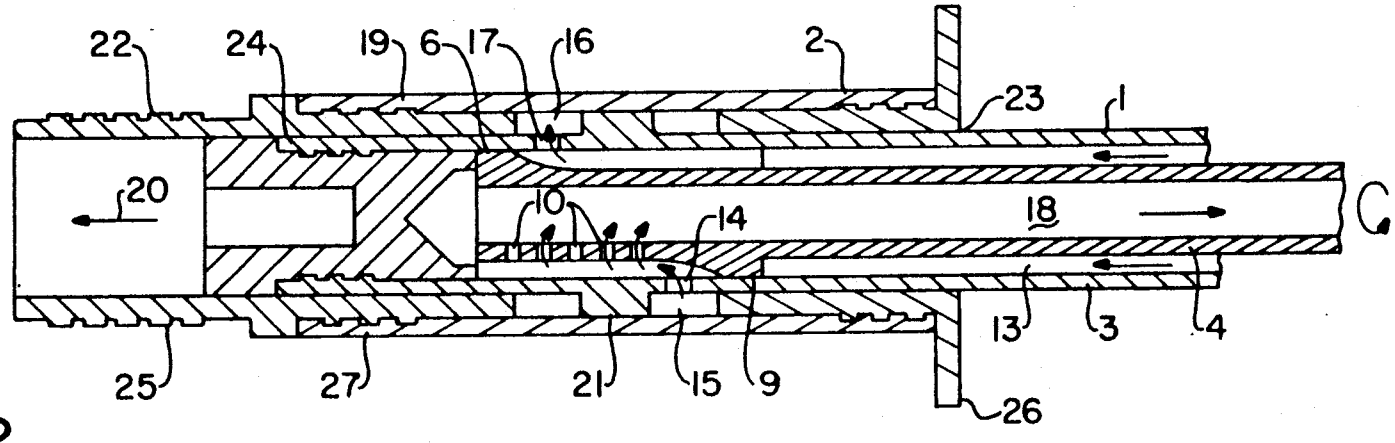
FIG. 2 is the same view of the same embodiment as in FIG. 1 with a rotary valve incrementally rotated from the view in FIG. 1.
Figure 3:
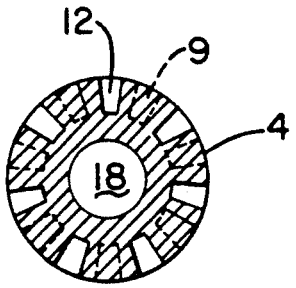
FIG. 3 illustrates in cross-section but not to precise scale the end of the rotary valve as used in the first embodiment.

Referring in detail to the drawings, in FIGS. 1 and 2 there is shown an inertial body 1 and a housing means 2.

With the inertial body 1 there are two coaxially aligned cylindrical conduits comprising an outer conduit 3 and an inner conduit 4 which at its bottom end 5 constitutes a rotary valve 6.

The rotary valve 6 is incremented around its circumference so as to leave a plurality of supply channels 7 and exhaust channels 8.

The exhaust channels 8 have an upper end 9 blocked and there is access through apertures 10 for hydraulic fluid into the centre of the conduit 4.

In contra fashion the supply channel 7 in each case has an open access at 12 to the supply hydraulic fluid 13 which is supplied at pressure.

There are a plurality of apertures 14 placed at the same incremental spacings around the circumference of the rotary valve 6 as are the respective supply channels 7 in the one instance, or the exhaust channels 8 in the other, but so that in any incremental position of the rotary valve 5, the supply channels 7 coincide with such an aperture 14 and thereby direct hydraulic fluid into a first working chamber 15.

In same manner, hydraulic fluid within a second working chamber 16 passes through a plurality of apertures 17 in the wall of the inertial body 1 and hence being guided through the exhaust channel 8 back into the exhaust conduit comprising the inner conduit 4.

With an incremental turn about the cylindrical axis of the rotary valve 6, the hydraulic fluid at pressure will then be redirected so that as it is directed through the annular space between the respective outer conduit 3 and the inner conduit 4, it will then be directed to enter through aperture 17 into the working chamber 16 hence causing by reaction, a resultant thrust on housing element 19 which will then be caused to move in the direction of arrow 20 while at the same time hydraulic fluid in the working chamber 15 will be allowed to exhaust through aperture 14 returning through apertures 10 to the passageway passing centrally through the inner conduit 4.

In this way by reason of the periodic and alternate directing of fluid to each side of piston element 21 there will be caused an appropriately periodically and alternately changing force with respect to the housing 2 and to any load which might be connected typically at the end 22 thereto.

As it will be further seen, however, housing 2 is allowed to move while maintaining a sealing connection between the matching faces at 23 and again at 24.

Further, however, the housing 2 is made up of a bottom member 25 and a top member 26 both of which are screwed with screw threads to outer housing 27.

There are rotational drive means coupled to the upper end of the inner conduit 4 which allow the rotational speed, that is the speed of the rotary valve 6 rotating about its own cylindrical axis to be held constant or varied in accordance with conventional control techniques.

Further, of course, the hydraulic fluid is supplied and taken using conventional conduit connections.

The point is that with the arrangement shown the inertial body 1 includes most of the hydraulic fluid which is in transit along the direction of the several conduits 3 and 4 and, of course, will include any rotary drive mechanism that is substantially connected therewith.

Of some significance also is the fact that by using the arrangement shown, the hydraulic fluid flow rate can be kept substantially constant in that its direction will substantially remain as a supply when passing through passage channel 7 and the return hydraulic fluid through passageway 18 will also remain at constant speed substantially.

The small amount of hydraulic fluid that must change direction is constrained to that which enters and exits the relatively small working chambers 15 and 16.

Further, it can be expected that there will be little reaction against any rotational drive of the rotary valve whether there is a substantially loaded load or a light load so that it can be expected that the rate of drive can be held relatively constant with relatively small power requirements.

Figure 5:
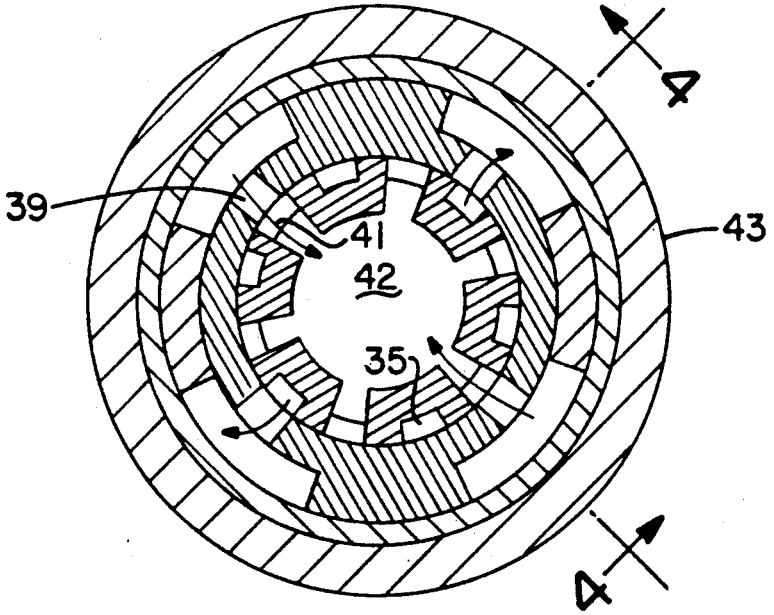
FIG. 5 is a cross-sectional view not to precise scale along the lines 5—5 in FIG. 4.
Figure 4:
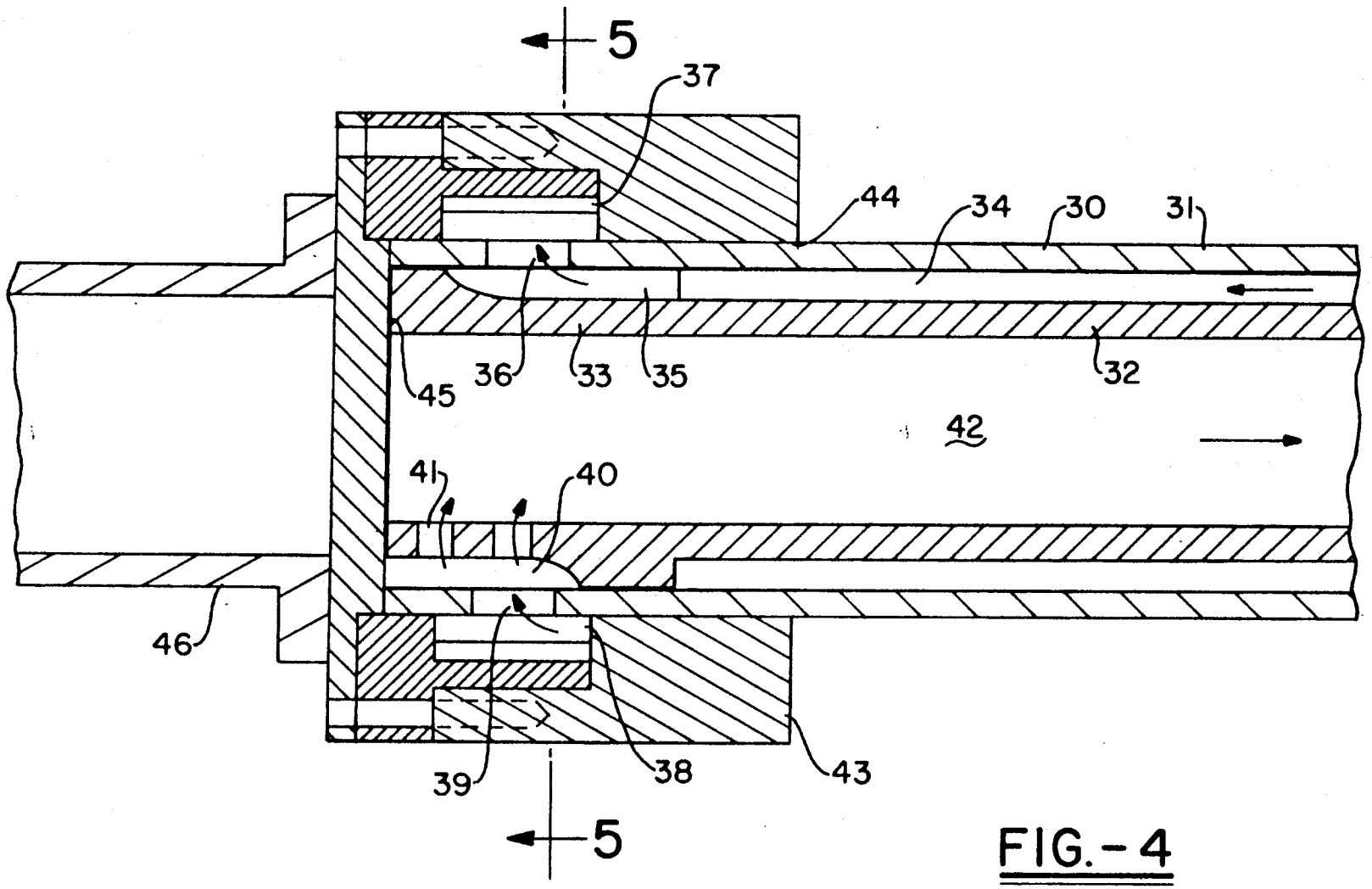
FIG. 4 illustrates a second embodiment providing for torsional vibration rather than longitudinal vibration.

In FIGS. 4 and 5, there are shown details relating to an assembly having very significant similarities to the first embodiment but in the second embodiment, the drive causes a torsional result rather than a longitudinal result.

Accordingly there is shown an inertial body 30 which includes an outer conduit 31 and an inner conduit 32 at the lower end of which at 33 there is provided a rotary valve which includes a plurality of incrementally located channels some of which act to direct fluid at pressure through the annular passageway 34 through passageway 35 through aperture 36 into a first working chamber 37.

At the same time, fluid within working chamber 38 is allowed to exhaust through aperture 39 directing channel 40 and apertures 41.

The fluid then passes through passageway 42 formed by the inner core of the cylindrical shape of the inner conduit 32.

As the inner conduit 32 rotates, the directing channel 35 will in turn then direct fluid at pressure through aperture 39 and into working chamber 38 while at the same time fluid within working chamber 37 will exhaust through aperture 36 and pass through apertures 41 into the relief passageway 42.

The respective working chambers 37 and 38 are held within a housing 43 which is relatively rotatable in the respective direction of urging which will be caused by this rotational action of the rotary valve 33 by being free to rotate firstly about the cylindrical matching faces as shown by 44 and the planar faces 45.

A convenient load can be attached to the housing 43, for instance the element 46, to which any load or driven assembly can be attached.

Once again the driven speed of the rotary valve 33 can be controlled by a controlled speed drive motor and connection of the hydraulic supply can also be by standard techniques.

Figure 7:
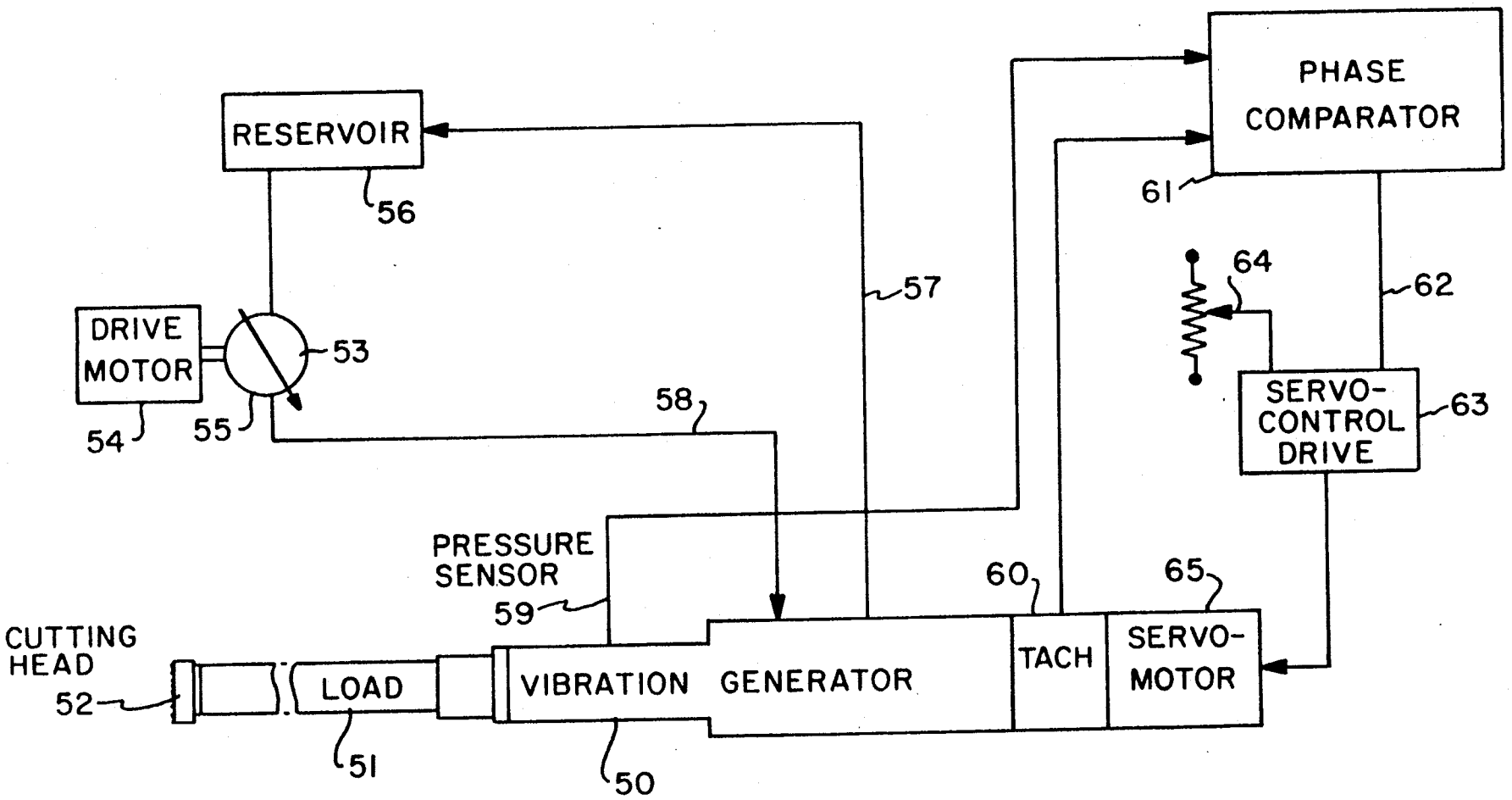
FIG. 7 is a view of an assembly in schematic layout showing the manner in which a feed-back control can effect control of the rotational speed of the apparatus and bring this and hold this at resonance with the load.

Now referring specifically to FIG. 7, a vibrational longitudinal drive generator 50 is coupled with a load 51 which in this case is coupled to a cutting head 52.

The generator 50 is coupled, however, to hydraulic pump means 53 which includes an electric drive motor 54 and a variable displacement pump 55.

There are appropriate reservoir means which act to collect exhaust through conduit 57 and, of course, provide fluid at pressure along line 58.

In order to effect a measurement of the pressure and flow rate components occurring within the generator 50, there is taken a pressure sensor at 59 and a tachometer speed reading at 60 both of which are fed into a phase comparator 61 from which there can be deduced the appropriate phase relationship and an error signal is then fed through line 62 into a servo-control drive 63.

This in turn sends a signal as governed by setting 64 to a servo-motor at 65.

In this way an appropriate setting can be effected to follow and correct the speed so as to match, if required, resonance of the combined housing and any attached load.

Figure 6A:
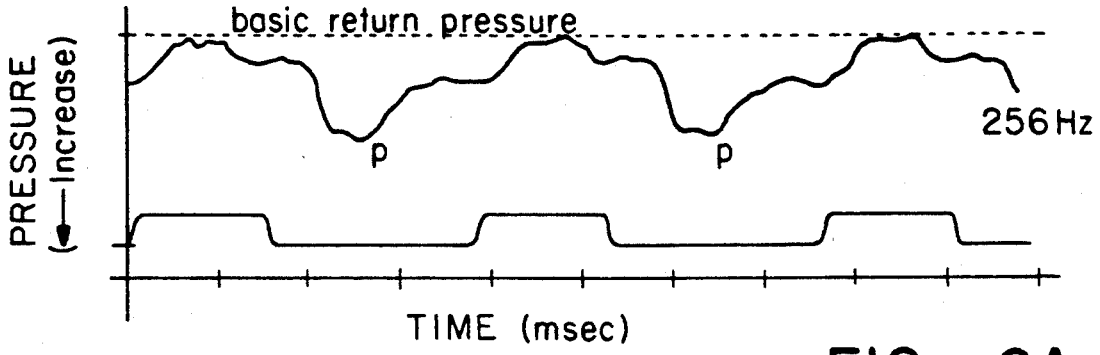
FIG. 6 illustrates wave forms by which detection of the speed of the driving generator is determined to be above or below the frequency of resonance of the attached load.
Figure 6B:
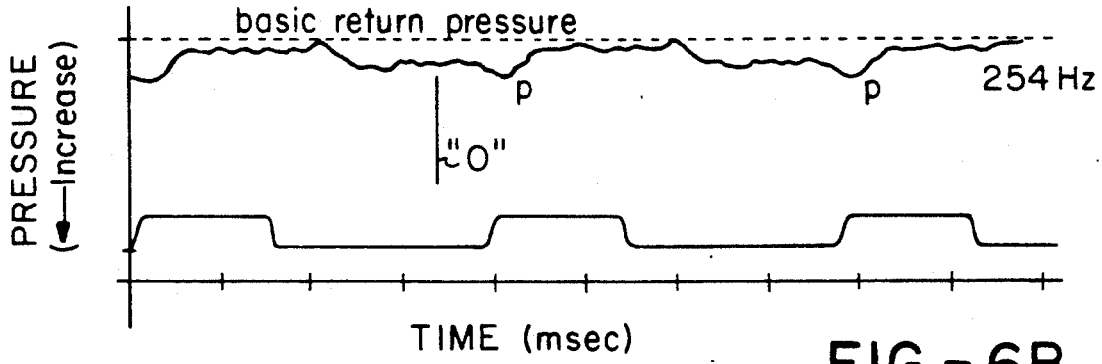
Figure 6C:
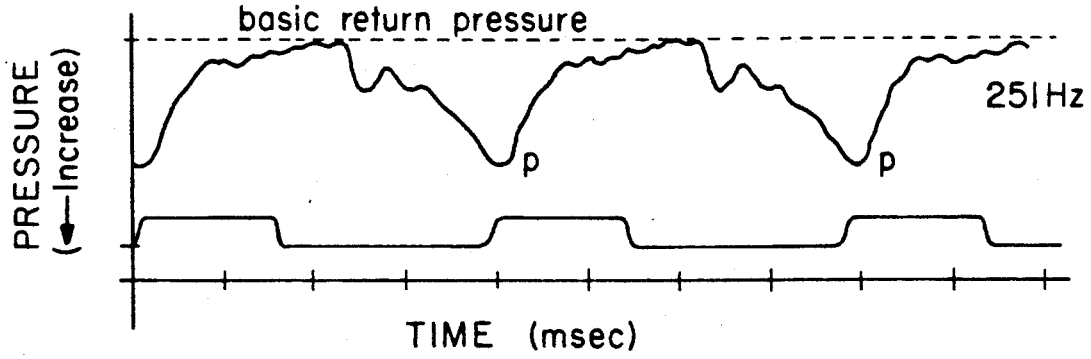

Information regarding pressure wave form is more specifically seen in FIG. 6 which shows comparative information for three slightly different frequencies being below, at and above resonance illustrating the change in wave forms relative to the pressure within working chambers.

The lower wave form in each case shows a reading from a tachometer which is driving a spool valve metering fluid to the respective working chambers. This wave form is used as a frequency reference and has a fixed but unspecified phase relationship with the porting inlets and outlets. For the display illustrated, the frequency reference output is used to trigger an oscilloscope recording the pressure wave forms and the display provides a time reference cycle by cycle even as the frequency changes.

The pressure of the working chamber measured (the "push" side) is plotted with an increase toward the bottom of the page. The pressure in the other working chamber is essentially equal but displaced 180°, or one half cycle in time.

The particular test used exhibits a resonant frequency just less than 255 Hertz, and at this frequency the pressure in the working chambers is lower than at frequencies either side of resonance.

It is accordingly possible for a human operator by visually observing the change in wave-shape as such to manually control the rotating speed of the rotary valve and hence the driving frequency.

However, it is self evident that by providing electronic detector means to detect this change will provide a control means to hold a driving frequency at or close to resonance with respect to any driven load.

It is noted the phase relationship of the present wave form compared to the port openings is a more sensitive indicator of the relationship of the drive frequency to the resonant frequency. Notice that at 251 Hertz, the pressure peak lags the line "◯" and at 256 Hertz the peak leads this timing event. The line "◯" was chosen as the mid-point of the port opening at 254 Hertz. Even at 254 Hertz the pressure wave form shows a slight lag indicating the resonant frequency to be just greater than 254 Hertz. However, the magnitude of this phase effect for a frequency shift as little as 1 Hertz (0.4%) means that an appropriate analogue, phase-locked loop method can be used to compute this effect and use this to effect a drive error signal to control the frequency and maintain this closely with respect to resonance.

We claim:

1. A vibrational power generator to effect a periodic varying force including an inertial body, a valve within the inertial body, housing means adapted to be affixed to load means and slidably movable with respect to the inertial body, a source of fluid pressure connected to the inertial body, said source supplying a substantially constant volume flow rate, means to control said valve relative to a reference frequency so as to periodically and alternately direct the fluid at pressure into a first working chamber and then a second working chamber, each working chamber being defined by the housing and the inertial body, and such that introduction of fluid at pressure into the first chamber will effect a force urging the housing to move in a first direction relative to the inertial body, and in which direction the housing means is moveable relative to the body, and introduction of fluid at pressure into the second chamber will effect a force urging the housing to move in a second direction which is opposite to the first said direction and in which second direction the housing means is movable relative to the body and further characterized in that there are means to detect a basic supply pressure of fluid being supplied into the respective working chambers, and there are means responsive to a wave-shape of such pressures such that with a negative slope, there will be effected a slowing of drive rate of the valve and with a positive slope an increasing of drive rate.

2. A vibrational power generator as in claim 1 wherein the valve periodically and alternately will allow exhaust of fluid subsequent to being directed into the respective working chambers.

3. A vibrational power generator to effect a periodically varying force as in claim 2 wherein there are means to direct said hydraulic fluid subsequent to exhaustion from a working chamber through the inertial body.

4. A vibrational power generator to effect a periodically varying force as in claim 1 wherein the fluid at pressure is a hydraulic fluid and there are means to direct said hydraulic fluid, within the inertial body, to the valve for direction to the working chambers.

5. A vibrational power generator to effect a periodically varying force as in claim 1 wherein the valve is a mechanical device which is rotatably driven whereby to effect the alternate and periodic direction of said fluid at pressure.

6. A vibrational power generator to effect a periodically varying force as in claim 1 further characterized in that the inertial body includes two coaxially aligned conduits, being an inner conduit and an outer conduit, there being thereby defined a first passageway through the inertial body between said inner conduit and said outer conduit, and a second passageway being through the inner conduit.

7. A vibrational power generator to effect a periodically varying force as in claim 1 wherein the valve is a mechanical device which is rotatably driven and wherein the means for effecting rotation of the valve comprise an inner conduit which is adapted to be rotated about is own cylindrical axis and the end of which is adapted to effect a valve-like action with respect to ports through an outer conduit.

8. A vibrational power generator to effect a periodically varying force as in claim 1 wherein the housing means are adapted to be slidably movable with respect to the inertial body by being sealably and slidably connected to slide along an axial direction of the conduits defining the inertial body.

9. A vibrational power generator to effect a periodically varying force as in claim 1 wherein the means to control said valve are controllable in speed.

10. A vibrational power generator to effect a periodically varying force as in claim 1 wherein the arrangement is adapted to be operated within the range of 20 to 1000 Hertz.

11. A vibrational power generator to effect a periodically varying force as in claim 1 wherein the arrangement is adapted to be operated within the range of 200 to 500 Hertz.

12. A vibrational power generator as in claim 1 wherein the said reference frequency is a resonant frequency of driven load.

* * * * *